United States Patent [19]

Tanzi

[11] Patent Number: 4,706,316

[45] Date of Patent: Nov. 17, 1987

[54] METHOD FOR PRODUCING FOOTWEAR

[76] Inventor: Giancarlo Tanzi, Via Cimitero, Vidor, Italy

[21] Appl. No.: 29,146

[22] Filed: Mar. 23, 1987

Related U.S. Application Data

[63] Continuation of Ser. No. 802,572, Nov. 27, 1985, abandoned, which is a continuation-in-part of Ser. No. 696,958, Jan. 31, 1985, abandoned.

[51] Int. Cl.[4] ..... A43D 3/12; A43B 23/07; A43B 23/08; A43C 13/14

[52] U.S. Cl. ..... 12/142 T; 12/146 D; 12/15; 36/77 R; 36/55; 36/68

[58] Field of Search ..... 36/12, 68, 69, 77 R, 36/73, 55; 12/146 D, 142 RS, 142 T, 142 K, 142 F, 15

[56] References Cited

U.S. PATENT DOCUMENTS

| | | | |
|---|---|---|---|
| 248,410 | 10/1881 | Dawes | 36/77 |
| 511,141 | 12/1893 | Herzog | 36/55 |
| 1,255,893 | 2/1918 | Krippendorf | 36/43 |
| 1,829,612 | 10/1931 | Sato | 36/43 |
| 2,010,092 | 8/1935 | Lawson | 12/146 D |
| 2,229,387 | 1/1941 | Parker | 36/72 R |
| 2,284,810 | 6/1942 | Engel | 12/142 MC |
| 2,348,300 | 5/1944 | Klaus | 36/43 |
| 2,404,586 | 7/1946 | Maling | 12/142 F |
| 2,585,588 | 2/1952 | Rice | 36/76 |
| 2,838,776 | 6/1958 | Tax | 36/44 |
| 2,866,211 | 12/1958 | Herlihy | 12/142 MC |
| 2,940,096 | 6/1960 | Bromfield | 12/142 F |
| 3,259,931 | 7/1966 | Levenson | 12/142 MC |
| 3,333,353 | 8/1967 | Garcia | 36/69 |
| 3,350,795 | 11/1967 | Schlecht | 36/55 |
| 3,601,908 | 8/1971 | Gilkerson | 36/43 |
| 3,705,463 | 12/1972 | Lown | 36/43 |
| 3,858,337 | 1/1975 | Vogel | 36/69 |
| 4,334,367 | 6/1982 | Salomon | 36/117 |
| 4,335,531 | 6/1982 | Salomon | 36/117 |
| 4,501,076 | 2/1985 | Dodds | 36/11 |
| 4,514,916 | 5/1985 | Aarflot | 36/117 |
| 4,551,929 | 11/1985 | Paris | 12/142 MC |

FOREIGN PATENT DOCUMENTS

| | | | |
|---|---|---|---|
| 747135 | 6/1933 | France | 36/55 |
| 758531 | 1/1934 | France | 36/55 |
| 769952 | 9/1934 | France | 36/77 R |
| 1010420 | 6/1952 | France | 36/43 |
| 1563447 | 3/1980 | United Kingdom | 36/55 |
| 2153655 | 8/1985 | United Kingdom | 36/71 |

*Primary Examiner*—Werner H. Schroeder
*Assistant Examiner*—Steven N. Meyers
*Attorney, Agent, or Firm*—Sheridan, Ross & McIntosh

[57] ABSTRACT

A method for the production of footwear is disclosed which comprises providing and attaching a midsole member with integrated toe and heel counters. The process provides for efficient use of labor and machinery by reducing the number of steps required in footwear production and by reducing the number of machines required. The method comprises placing the midsole over a liner, drawing a pre-formed upper over the midsole and attaching a sole to the upper. Attachment of the components is preferably by a heat-activated glue. The midsole component is adaptable to a number of applications by modifying such aspects as the size and shape of the toe and heel counters, the size, shape and/or presence of side walls, the contour and thickness of the bottom, and the attachment of shanks or other stiffening or resiliency modifying members.

5 Claims, 4 Drawing Figures

METHOD FOR PRODUCING FOOTWEAR

This is a continuation, of application Ser. No. 802,572, filed Nov. 27, 1985, which is a continuation-in-part of U.S. application Ser. No. 696,958, filed Jan. 31, 1985 both now abandoned.

FIELD OF THE INVENTION

The present invention relates to a method for producing footwear, and in particular to a method for producing footwear which has a midsole with integrated toe and/or heel counters.

BACKGROUND INFORMATION

Although methods of producing footwear have long utilized machinery to help reduce labor costs, a large portion of the costs of producing footwear still is attributable to labor costs. In addition, to the extent footwear production has become mechanized, the economic advantages of mechanization are lessened when the machinery involved is under-utilized as, for example, by being idle for a significant portion of the footwear-making process. Thus, in general, the footwear production industry is hampered by processes which require a relatively large investment in labor and which do not provide for efficient utilization of machinery.

The problems of uneconomical methods of production are particularly acute in the sporting footwear industry, such as the hiking, skiing, and climbing footwear industries. This is because these types of footwear must combine durability, strength and comfort with the forms of resiliency and strength which are peculiarly required in the footwear intended for each type of sport. In the past, production of such footwear has required a number of steps such as stitching, nailing, gluing, all performed in a required sequence. The large number of steps required during actual construction of the footwear has required investment of a relatively large amount of labor time.

In general, these methods for the production of footwear, and particularly of sporting footwear, have begun with providing a number of pieces of substantially flat material including leather for the uppers, material for toe and heel counters, an insole, and an outersole.

According to the conventional methods of production, the piece forming the upper is joined along the back (heel) edges and a liner layer is attached to the inside of the upper by sewing at least along certain portions of the upper. Toe and heel counters are selected to match the size of the footwear being constructed. These toe and heel counters are placed between the liner and the upper and glue is applied. This assembly is then placed over a last which will act as a form for shaping the upper, liner and counters to the desired contours. The last is thus in the shape desired for the interior space of the footwear. An insole is attached to the bottom of the last. The upper, in conventional processes, is temporarily nailed or tacked to the last. The upper/liner/last assembly is placed in a lasting machine which applies pressure to stretch the upper over the last and form the upper, toe and heel counters and liner in the desired contours. The bottom edges of the upper, counters and liner are pulled around the bottom edges of the last and attached to the bottom surface of the insole by gluing, stitching, and/or nailing. In particular, it is common to glue and staple the upper, counters and liner to the bottom of the insole around its circumference, to additionally nail the heel portion of the upper to the bottom of the insole, and to sew the toe of the upper to the bottom of the insole. Such sewing produces stitches which extend through the insole, adversely affecting the waterproof qualities of the insole and also affecting the comfort of the wearer. After the gluing, sewing and nailing steps, the upper/insole/last assembly is heated, as by placing the assembly in an oven, in order to activate the heat-activated glue. After the glue attaching the bottom edge of the upper to the bottom of the insole has set, the staples are removed. The last is removed from the assembly and the lower surface of the assembly is subjected to grinding in order to even the surface and remove excess adhesive. Next, the bottom edge of the upper which has been glued to the insole is stitched to the insole using a machine especially designed for the purpose. In order to ensure an even surface for attachment of the sole, a filler material is applied to the bottom of the assembly. An adhesive is applied to the leveled lower surface of the assembly and this assembly and the sole are heated to activate the adhesives. The assembly and the sole are pressed together in a vise-type apparatus to ensure adhesion. At this point the assembly is essentially complete and the footwear is ready for final finishing and preparation for shipment.

As is apparent from the foregoing description, conventional methods for production of footwear are complicated, labor intensive, and require use of a number of specialized machines. Because the footwear is produced largely from unformed, flat, "raw" materials, a large amount of labor is required to bring the product to its final form. In addition, a number of specialized machines such as a lasting machine and a machine designed to sew the upper/liner to the insole are required. Since not all machine steps require the same amount of time, certain machines have a high proportion of idle time, further degrading the economics of footwear production.

Conventional methods of footwear construction also place constraints on the type of material which can be used. The multiple heating steps employed in conventional methods have a detrimental effect on many materials which could otherwise be used to provide thermal insulation or waterproof qualities to the footwear, such as certain types of plastics. The compression which occurs during treatment in a lasting machine is detrimental to insulating materials which depend on maintenance of a degree of loft for their insulating qualities. Materials which would otherwise provide waterproof qualities have those qualities compromised by a sewing step, often making necessary the provision of a sealant to accomplish waterproofing.

It is apparent, therefore, that several advantages could be obtained from the development of a process for production of footwear which yields the high quality particularly required for sports footwear but is less labor intensive and produces better utilization of machinery. In that regard, the present invention is directed to providing a process for producing footwear which efficiently utilizes both labor and machinery.

SUMMARY OF THE INVENTION

A process is disclosed for the production of footwear which provides efficient use of labor and machinery by designing the process to incorporate a novel midsole member with integrated toe and heel counters. The midsole is adaptable to a number of applications by modifying such aspects as the size and shape of the toe and heel counters, the size, shape and/or presence of side walls, the contour and thickness of the bottom, and the attachment of shanks or other stiffening or resiliency modifying members.

According to the method of the present invention, a slipper-shaped (i.e. having a bottom surface) liner is pulled over a support. Since the support, unlike a last, does not act as a form (because the lasting machine is no longer required), the support does not need to be in the shape desired for the interior space of the footwear. Glue is applied to the liner and the midsole with integrated toe and heel counters is placed over the liner. Another layer of glue is added and a pre-formed upper is pulled over this assembly using a pulling machine. The pre-formed upper is also of a slipper-shape (i.e. it has both upper and bottom surfaces). After the pre-formed upper is pulled over the liner, a sole is glued to the upper. After removal from the form, the entire assembly is heated to activate the glue layers and pressed in a vise-like machine to ensure adhesion. The footwear is now assembled and ready for finishing and shipment.

DETAILED DESCRIPTION OF THE PREFERRED EMBODIMENT

The present invention is a method for producing footwear which is simpler and provides better utilization of labor and machinery than conventional methods. According to the method of this invention, certain components of the footwear are pre-formed before assembly so that the stitching steps are performed before the assembly of the parts of the footwear. Multiple heating steps, stitching steps, and treatment in a lasting machine can be eliminated, and a simple support can be substituted for a last. The method involves providing pre-formed components and particularly providing a pre-formed midsole with integrated toe and heel counters. Provision of such a midsole allows accurate control of the stiffness of the footwear, allows for construction of a lighter footwear, allows for footwear with enhanced thermal insulation qualities and allows for a method of production which is versatile with respect to the types of footwear produced.

Figure 1:
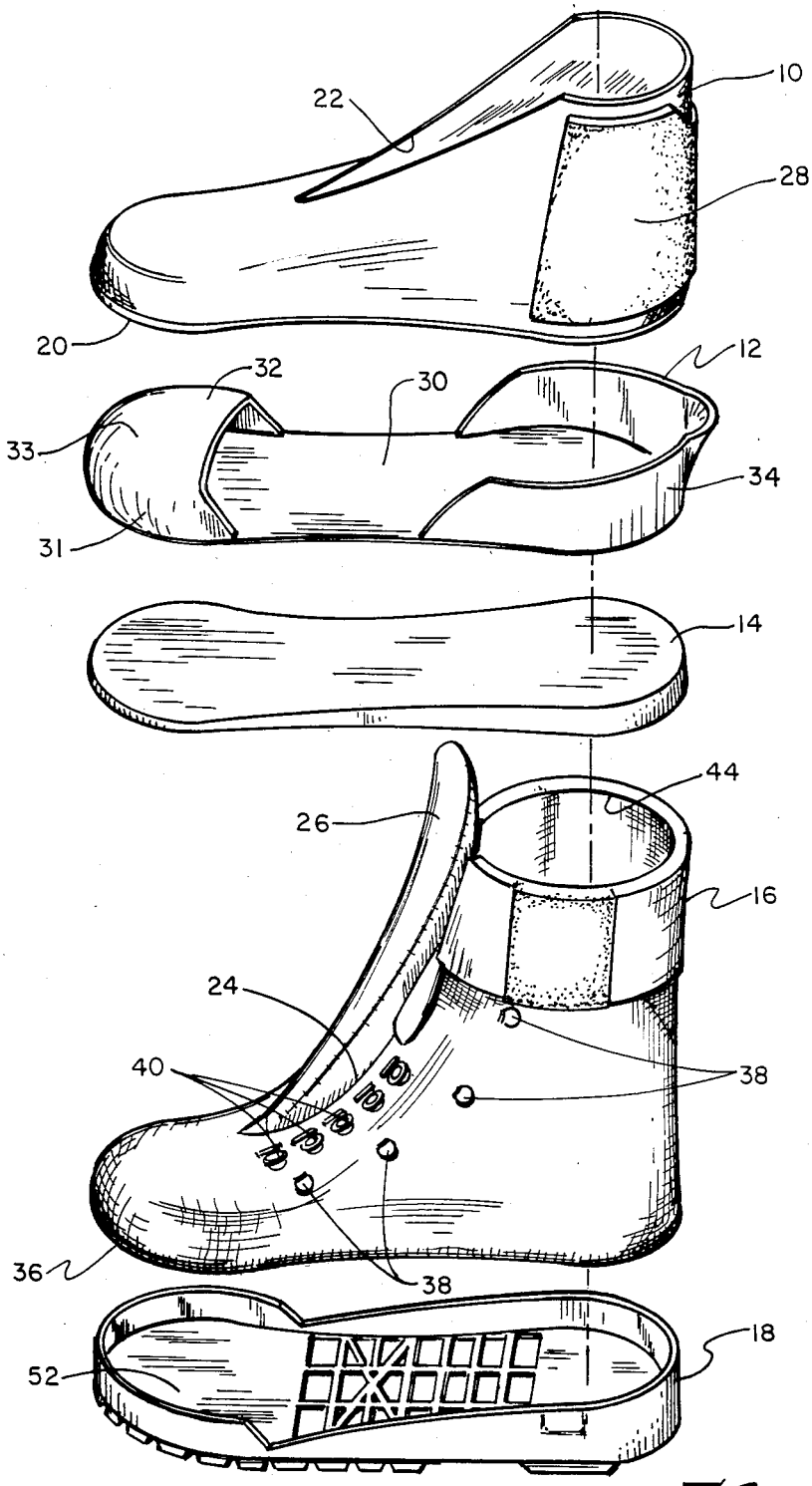
FIG. 1 is an exploded view of the footwear showing the relationship of the liner, midsole, shank, upper and sole.

Referring now to FIG. 1, a number of pre-formed components are provided in order to practice the construction process of the present invention. These components include a liner 10, a midsole 12, an optional shank 14, an upper 16 and a sole 18.

The liner or "sock" 10 is preferably pre-formed into a slipper-shaped component, i.e. a component comprising a bottom surface 20 as well as connected toe and heel surfaces. It is not critical that the liner 10 have a bottom surface 20, since it is possible to practice the method of the present invention and obtain advantages therefrom in the absence of such a liner bottom surface. However, it is preferred to provide a pre-formed liner 10 having a bottom surface 20. Such a bottom surface 20 provides both a larger area for gluing to other components of the footwear and provides for a smooth bottom surface so as to provide for comfort of the wearer.

The particular shape of the liner 10 will, of course, depend on the type of footwear which is being constructed. A high-topped boot, for example, will generally require a liner having a relatively tall ankle portion. The depth of the throat or cutout portion 22 extending from the front of the ankle portion towards the toe will largely depend upon the shape of the throat 24 and tongue 26 of the finished footwear. Padding material 28 may be added in the ankle area or elsewhere. The liner 10 may be formed of a variety of natural and synthetic materials including leather and CAMBRELLE TM and is most preferably formed of a material having good thermal insulation properties. Since, unlike conventional processes, the process of the present invention does not substantially permanently crush the liner material, the liner may be formed of a material which depends upon a certain loft to maintain its thermal insulation qualities.

The pre-formed midsole 12 comprises a sole portion 30, a toe counter 32 and a heel counter 34. The toe counter 32 and heel counter 34 are integrally formed with the sole portion 30 so that the midsole 12 is a single integral piece. The integral midsole 12 is preferably formed by injection molding using a desired materials, such as plastic, so that the necessary mechanical rigidity and torsional stability are achieved. This is important when the footwear requires relatively increased strength and support because of its intended use, such as in climbing.

The toe counter 32 is preferably a boxed-in toe counter, that is a toe counter which contains both a side wall surface 31 and a top surface 33 integral with the side wall surface 31. The top surface 33 generally lies in a plane parallel to the plane of the sole portion 30. The shape of the midsole 12 will vary according to the type of footwear being produced. Specifically, the shape of the midsole 12 is a function of the mechanical properties desired in the footwear, such as stiffness and torsional stability, the attachments or apparatus required for the particular footwear such as toe clamp means for ski footwear, or the desired final shape of the footwear, such as high topped footwear as opposed to low cut footwear or footwear having a particular desired throat and tongue length.

The mechanical properties of the midsole, for example the resiliency and flexibility of the midsole or the torsional resistance or stability of the midsole, can be controlled by providing a midsole with varying thickness, by adjusting the material from which the midsole is formed, by varying the shape of the particular components of the midsole or by adding components such as extended side walls or ribbing to the midsole. By varying the thickness of parts of the midsole, it is possible to obtain a midsole with resiliency or torsional stability which is different at different portions of the midsole, as might be required for footwear designed for particular applications. For example, in footwear designed for rock climbing, it is often desirable to have enhanced stiffness along the toe to heel axis in the toe area of the footwear in order to maintain proper support during a "toehold" climbing position, and yet to have an amount of resiliency in the side-to-side axis. Such an objective can be obtained by providing a midsole 12 which is relatively thick along the toe to heel midline but thinner along the sides of the midsole.

Stiffness, resiliency and torsional stability can also be adjusted by adjusting the contours and/or thicknesses of the toe and/or heel counters. For example, the toe counter 32 of the midsole 12 may be formed with a top surface 33 having an edge which extends forward (i.e. towards the toe end of the midsole 12), resulting in enhanced flexibility of the toe portion of the footwear. Mechanical properties of the footwear may also be adjusted by providing additional components, for example an extended side wall component comprising a projection extending perpendicularly to the sole portion 30 along its periphery between the toe and heel counters 32 and 34.

When the footwear is to be used with attachments or accessories, mounting means for these attachments or accessories can be provided on the midsole 12. For example, when the footwear is intended for attachment to skis, for example, touring or cross-country skis, a toe piece suitable for engagement with ski bindings can be integrally formed on the midsole 12. When constructing a ski touring boot, it is particularly preferred to provide both a ski attachment mechanism and a toe counter 32 with a forward-extending edge. The attachment mechanism may be on the midsole 12 or on the attached shank 14. It may be necessary to modify the upper such as by providing a hole in the toe portion so that the attachment mechanism can project through the upper so as to be accessible to the user. The toe counter 32 in a ski touring boot is preferably formed with an edge which extends forward nearly to the side wall portion 31 of the toe counter 32, so that the upper surface 33 of the toe counter 32 is in the form of a small ledge.

For certain footwear applications, it is preferred to provide for adjustment of the footwear stiffness or stability or to provide for engagement of attachments or accessories by providing a shank component 14. The shank 14 may be constructed in a variety of shapes in order to provide the mechanical properties and attachment surfaces required for the particular type of footwear. The shank 14 may be substantially the same size and shape as the sole portion 28 of the midsole 12, or it may be in the shape of a stiffening bar or shaft, as required to produce the desired mechanical or attachment properties as will be apparent to those skilled in the art. It is preferred, however, that the shank 14, if it is used, be formed so as to mate with bottom portion of the midsole 12 in order to provide an even surface for attachment of other components of the footwear and to provide for comfort of the wearer.

The shank 14 may be constructed of a variety of materials, for example plastic, rubber, leather, metal, KEPLAR TM, or glass fibers. By providing the shank 14, it is possible to produce footwear with controlled mechanical properties, but which is lighter than footwear produced by conventional means. When the footwear is intended for a cold weather application, it is preferred that the shank 14 comprise a thermally insulating material.

When a shank 14 is provided, it is preferred that the shank 14 be attached to the midsole 12 prior to commencing the footwear assembly process, i.e., the preformed midsole component of the footwear assembly operation comprises an attached shank, if such is to be included in the footwear. Shank 14 can be attached to midsole 12 by a number of processes including gluing, riveting, sewing, etc. When the footwear is intended for cold weather applications, it is preferred that attachment of shank 14 to midsole 12 be done by means of an adhesive, preferably a heat-activated adhesive.

The upper 16, according to the method of the present invention, is pre-formed, prior to assembly of the footwear, into a substantially slipper-shaped component, i.e. a component comprising a bottom surface 36 as well as a toe surface joined to a heel or ankle surface. The bottom surface 36 preferably covers the entirety of the bottom portion of the upper 16 in order to maintain the components of the footwear in the desired relationship. Thus, any sewing steps required for the formation of the upper 16, for example sewing a bottom surface 36 to form the upper 16 are preferably performed prior to assembly of the footwear, i.e. are performed prior to attachment of the upper component 16 to any other component of the footwear. It is preferred that the upper 16 be fully formed prior to assembly, including providing the tongue 26, lacing hooks 38 and eyelets 40. The upper 16 may be formed from any conventional upper material, such as leather, fabric or plastic, provided that the upper 16 has sufficient pliability that it may be drawn over a midsole/liner assembly, in the manner described below, without tearing or otherwise disfiguring the upper 16.

The sole component 18 can be any conventional sole component consistent with the methods of attachment described below. Specifically the sole component 18 must be in a form suitable for attachment to the bottom surface of the liner 16, preferably without performance of any additional steps such as leveling the surface of the sole 18. Further, the sole 18 should be composed of a material which can be permanently adhered to the bottom surface of the upper 16 by means of an adhesive, preferably a heat activated glue.

The manner of assembly of the footwear will now be described. The liner 10 is placed on a support 42. The support 42 somewhat resembles a last such as that used in conventional footwear assembly. However, the support 42 differs from a last in that it is not necessary for the support 42 to be in a particular shape. This is because the support 42 does not function as a form for determining the shape of the footwear. Although it is preferred to place the liner 10 on the support 42 prior to other assembly steps, the liner 10 may be placed on the support 42 at any time previous to the step of drawing the upper 16 over the midsole/liner assembly as described below.

An adhesive, preferably a heat activated adhesive, is applied to the exterior of the liner 10, preferably on the bottom 20, toe, and heel sections of the liner 10. The midsole 12 is placed over the liner 10, preferably by inserting the toe of the liner 10 into the toe counter 32 of the midsole 12 and then pressing the heel portion of the liner 10 into the heel section of the midsole 12 so that the heel portion of the liner 10 lies adjacent the heel counter 34 of the midsole, the toe section of the liner 10 lies adjacent and within the toe counter 32 of the midsole 12, and the bottom portion 20 of the liner 10, if any, is adjacent the sole portion 30 of the midsole 12.

An adhesive, preferably a heat activated glue, is applied to the exterior portions of the midsole 12 and the attached shank 14, if any is provided.

The upper 16 is next drawn over the midsole/liner assembly. Because the upper 16 is pre-formed with a bottom surface 36 attached, it is not possible to employ an open bottom portion of the upper to assemble the upper component of the shoe as is done in conventional footwear production methods. Rather, the preassembled upper 16 is drawn over the midsole/liner assembly through a throat opening 44 of the upper 16, somewhat in the manner that an overshoe is drawn over a shoe. Because the upper 16 is preferably tight-fitting with respect to the midsole/liner assembly, it is preferred that the midsole/liner assembly be placed on a support 42 during such drawing operation, as described above.

Figure 2:
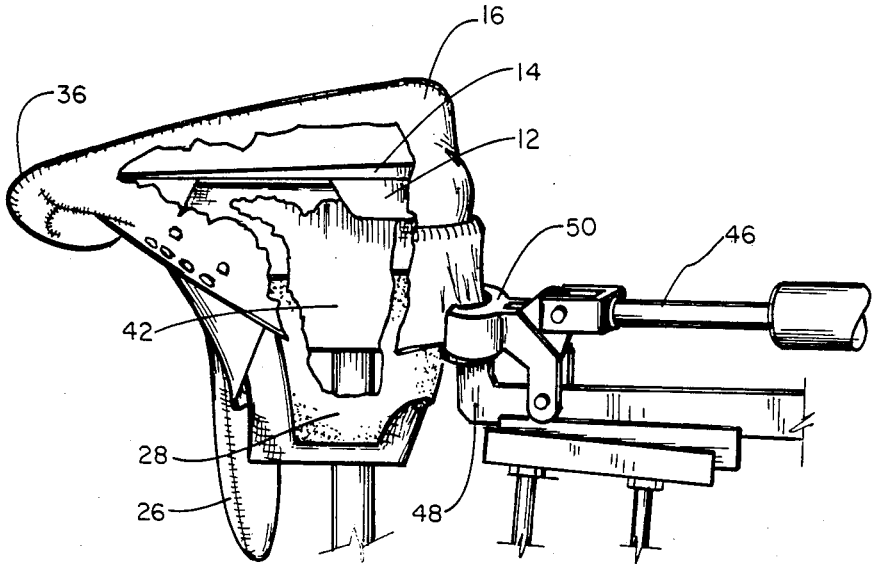
FIG. 2 is a perspective view of the upper being drawn over the midsole-liner assembly, with cutaways showing the midsole, liner, shank and support.
Figure 3:
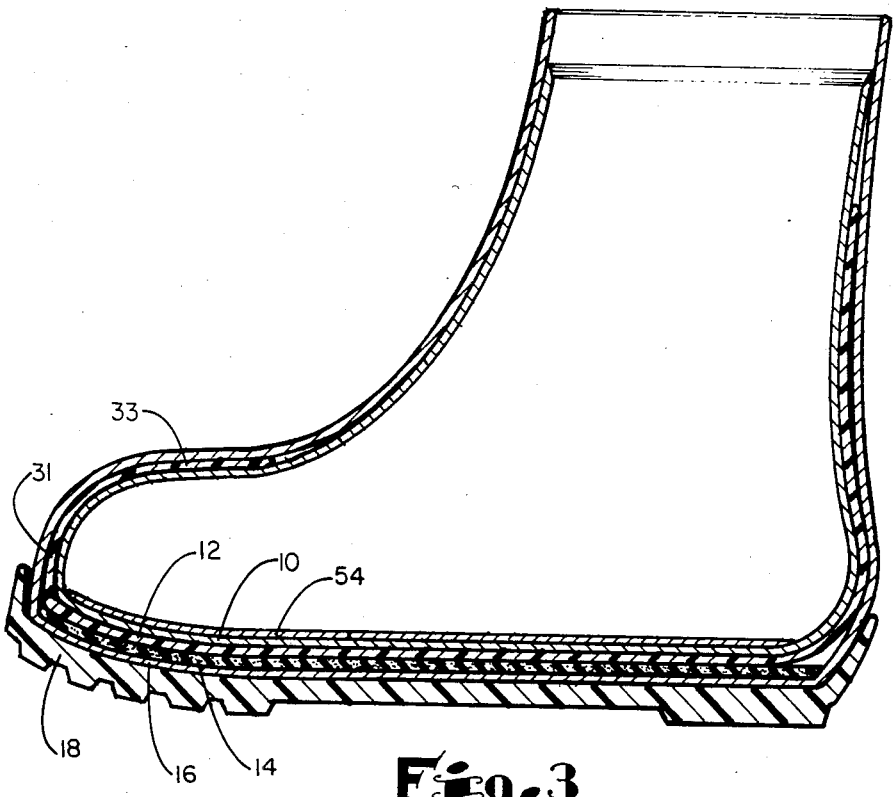
FIG. 3 is a longitudinal cross-section of the assembled footwear.
Figure 4:
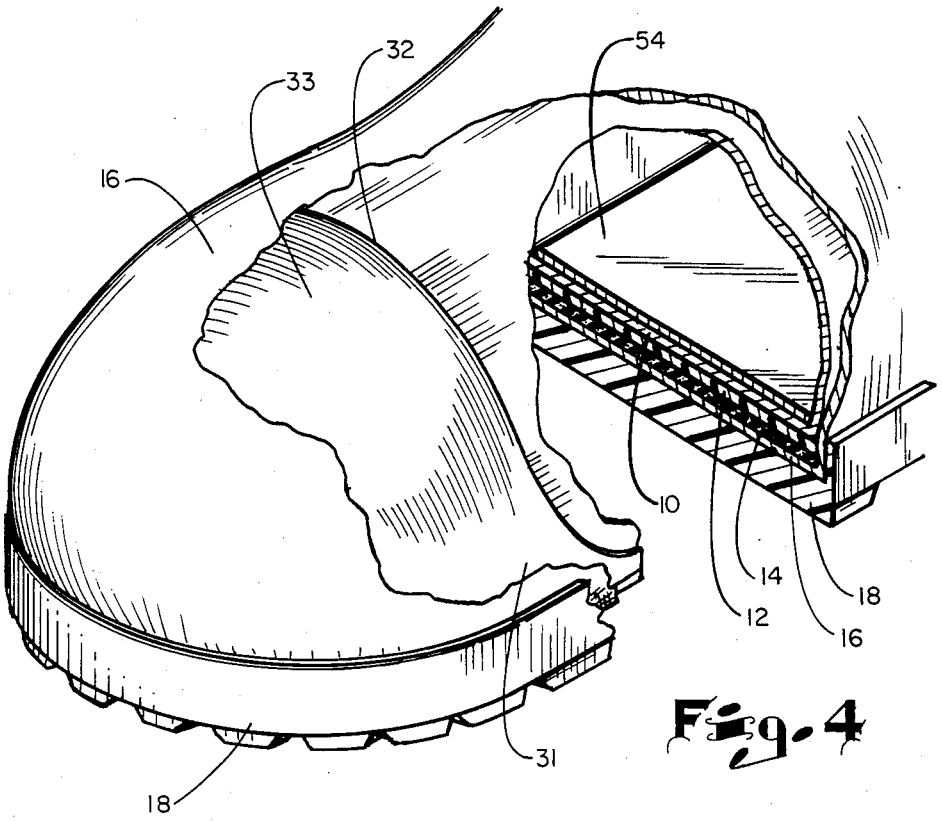
FIG. 4 is a perspective view of the toe portion of the assembled footwear, with cutaways showing the midsole, liner, shank and foot bed.

To assist in the drawing operation, it is preferred to employ a pulling machine 46, as best illustrated in FIG. 2. The pulling machine 46 comprises two arms 48 (partially obscured) and 50. The first arm 48 is configured to hold the midsole 12 stationary while the second arm 50 grips the upper 16 and pulls it towards the midsole 12.

An adhesive, preferably a heat activated adhesive is applied to the exterior bottom portion 36 of the upper 16 and/or the interior bottom portion 52 of the sole 18. The midsole/liner/upper assembly and the sole 18 are heated to activate the glue, by such means as placing in an oven, by ultrasound heating or microwave heating. The sole 18 is attached to the bottom 36 of the upper 16, preferably by pressing the upper 16 and sole 18 together in a vise-like mechanism. The support 42 is removed and a footbed 54 is inserted through the throat 44 and attached to the interior bottom surface of the liner 10.

After the footwear is cooled, it is ready for final finishing and preparation for shipping. This may include removing stray glue, adding laces, polishing, and wrapping or boxing.

A number of variations of the process can be performed within the spirit and scope of the present invention. The upper 16 may be drawn over the midsole 12 before the midsole 12 is attached to the liner 10. The shank 14 may be attached to the midsole 12 after the midsole 12 is drawn over the liner 10. The support 42 may be removed from the liner 10 immediately after the upper 16 is drawn over the midsole/liner assembly, or the support 42 may remain in the liner 10 until after attachment of the sole 18 to the upper 16. When engagement mechanisms such as ski attachment means are provided on the midsole 12, openings may be provided in the upper 16 and/or sole 18 so that the engagement mechanisms may protrude outwardly to be accessible to the wearer.

Based on the foregoing detailed description of the present invention, a number of advantages of the invention are easily seen. The present invention minimizes labor required for assembly of footwear by providing components which are pre-formed, by eliminating steps which were performed in conventional footwear assembly, such as treatment in a lasting machine, sewing, leveling, grinding, multiple heating, nailing, etc. A substantial savings in labor can be accomplished by the process of the present invention compared to conventional methods of footwear production. Provision of a pre-formed midsole with integrated toe and heel counters allows for control of mechanical properties of the footwear, such as rigidity and torsional stability, in a uniform manner. Such a midsole can be formed of substantially waterproof materials which are not defeated by steps used in conventional footwear assembly such as sewing or multiple heating. Because the toe counter and the heel counter are integrally formed with midsole 12 it is not necessary to separately select proper sizes of toe counters and heel counters during the assembly operation. Because machines such as sewing machines and lasting machines are not needed in the assembly process of the present invention, required investments in machinery are reduced. Utilization of those machines which are employed is enhanced by reducing the proportion of time such machines are idle. Components can be provided with insulating material which require maintenance of loft for their insulating properties without destroying such loft as would be done by steps which were performed in conventional footwear assembly such as lasting, sewing, and multiple heating. Since the toe and heel counters are integrally formed with the midsole, they do not require manipulation or heating to mold them to the desired shape and harden them, as was done in conventional methods of footwear production and which often lead to material defects and premature detericration of these parts. Because the midsole, integrated toe counter and heel counter can be formed of a plastic in desired contours and thicknesses by an injection molding process, and because mechanical properties of the footwear can be adjusted by addition of a shank, which can be formed of a plastic material, footwear with the desired mechanical properties can be formed which is of lighter weight than comparable footwear formed according to conventional means.

Although the present invention has been described with reference to certain embodiments, it should be appreciated that further modifications can be effected within the spirit and scope of the invention.

What is claimed is:

1. A method for making footwear, comprising:

pre-forming an upper;

pre-forming a liner;

integrally forming together a sole, a toe counter and a heel counter to define a single piece midsole;

providing apparatus for supporting at least portions of the footwear, wherein said apparatus for supporting is used only as a support for portions of the footwear during the making thereof and wherein at least one of said pre-formed upper, said pre-formed liner, and said integrally formed midsole is used in defining at least one of the size and shape of the footwear during the making thereof;

placing at least portions of said liner in contact with portions of said midsole, wherein portions of said toe counter lie over portions of said liner and wherein said heel counter is positioned outwardly of portions of said liner;

forming a midsole/liner assembly using said midsole and said liner by attaching said midsole and said liner together;

providing an apparatus used for pulling said upper, said apparatus including first arm means and second arm means;

grasping said midsole using said first arm means of said apparatus for pulling;

after forming said midsole/liner assembly, pulling said upper outwardly of said midsole including said heel counter using said second arm means of said apparatus for pulling wherein said upper is tightly fitted with respect to said midsole/liner assembly;

using attaching means to attach said upper to said midsole; and attaching a sole to said upper to form the footwear that includes said upper, said liner, said midsole and said sole.

2. A method, as claimed in claim 1, further including:

pre-forming a shank; and attaching said shank to said midsole.

3. A method, as claimed in claim 1, further including:

pre-forming a foot bed; and attaching said foot bed to the interior bottom surface of said liner.

4. A method, as claimed in claim 1, wherein:

said step of pre-forming a liner includes providing said liner with a bottom surface.

5. A method, as claimed in claim 1, wherein:

said step of pre-forming an upper includes providing a bottom surface of said upper.

* * * * *